US006116563A

United States Patent [19]

Tsai

[11] Patent Number: 6,116,563

[45] Date of Patent: Sep. 12, 2000

[54] CHRISTMAS TREE WITH IMPROVED BRANCH JOINT

[76] Inventor: Yuan-Hui Tsai, No. 56, Tzyh-Li Rd. I, Nankan Industri Dis., Nantou, Taiwan

[21] Appl. No.: 09/127,873

[22] Filed: Aug. 3, 1998

[51] Int. Cl.[7] ..... F16M 13/00

[52] U.S. Cl. ..... 248/512; 211/205; 248/278; 428/8; 428/18

[58] Field of Search ..... 248/512, 278, 248/513, 514, 519, 520, 523, 538; 211/196, 205; 428/8, 18, 19, 20; 47/41.01, 41.13, 41.15, 42; 431/295, 126

[56] References Cited

U.S. PATENT DOCUMENTS

| | | | |
|---|---|---|---|
| 3,682,753 | 8/1972 | Willinger | 248/27.8 |
| 4,273,814 | 6/1981 | Koehler | 428/8 |
| 4,343,842 | 8/1982 | Chase | 428/8 |
| 4,447,279 | 5/1984 | Boisvert et al. | 156/61 |
| 4,451,510 | 5/1984 | Boisvert et al. | 428/8 |
| 5,015,510 | 5/1991 | Smith | 428/18 |
| 5,087,012 | 2/1992 | Doublet | 248/512 |

*Primary Examiner*—Ramon O. Ramirez
*Assistant Examiner*—Tan Le
*Attorney, Agent, or Firm*—Smith, Gambrell & Russell, LLP

[57] ABSTRACT

A branch joint for use with a christmas tree to connect a plurality of additional branches to trunk of the christmas tree, are designed to an umbrella-shaped body. A plurality of top and bottom ellipses respectively distributed on the top and bottom circumference of said body. A plurality of recesses form on a top edge of said body. Meanwhile, the additional branches are capable of being respectively inserted into said top ellipses, through the bottom ellipses, to be inward bent at a specific angle then for retaining a distal end of each branch within the corresponding recess whereby the branches and the umbrella-shaped body are retained together in a more natural, simple and useful manner.

4 Claims, 6 Drawing Sheets

CHRISTMAS TREE WITH IMPROVED BRANCH JOINT

FIELD OF THE INVENTION

The present invention relates to a christmas tree used for ornamentation, particularly to an artificial Christmas tree with an improved branch joint for firmly securing additional branches to a trunk of the christmas tree.

DESCRIPTION OF PRIOR ART

In general, conventional artificial christmas tree is fixedly attached with a number of bunches of additional branches in a direction parallel to a trunk of the tree by way of the winding of the iron wire for convenience of transportation and packing. In use, the consumers can bend the attached branches at a desired angle by means of flexibility of the iron wire. However, it results in the wastes of the time and labor, and the ready break of the iron wire upon the repeated bending thereof.

Recently, as shown in FIGS. 1, 2A & 2B, although there are some inventions in improving a claw type branch joint 1A to which is capable of firstly securing additional branches. Meanwhile, a retention claw 3A of the joint 1A must be firstly extended through and retained with by a nut 4A thereby retentively attaching the branches 2A to the nut 4A. However, as aforementioned, the cost and time in assembly and fabrication are still higher. Additionally, the attached branches may be readily deformed to result in an unstable construction thereof. Therefore, such design may obtain non-benefit in economy and usefulness to sale.

SUMMARY OF THE INVENTION

Based on the foregoing disadvantage, it is an objective of this present invention to provide a christmas tree with an umbrella-shaped body of a branch joint which offers a lower cost, a easy assembly, a simplified structure and a more natural appearance for the retention between the branches and the branch joint.

A further objective of this present invention provides a christmas tree with an umbrella-shaped body of a branch joint which utilizes a pair of top and bottom ellipses thereof to facilitate the adjustable angles of the retained branches in a space therebetween.

Another further objective of this present invention provides a christmas tree with an umbrella-shaped body of a branch joint which utilizes a recess, a pair of top and bottom ellipses thereof to constitute an optimal retentive design of achieving a stable construction which is capable of being not readily deformed.

BRIEF DESCRIPTION OF THE DRAWINGS

In order that the present invention may more readily be understood the following description is given, merely by way of example with reference to the accompanying drawings, in which.

DETAILED DESCRIPTION OF THE PREFERRED EMBODIMENT

Figure 1:
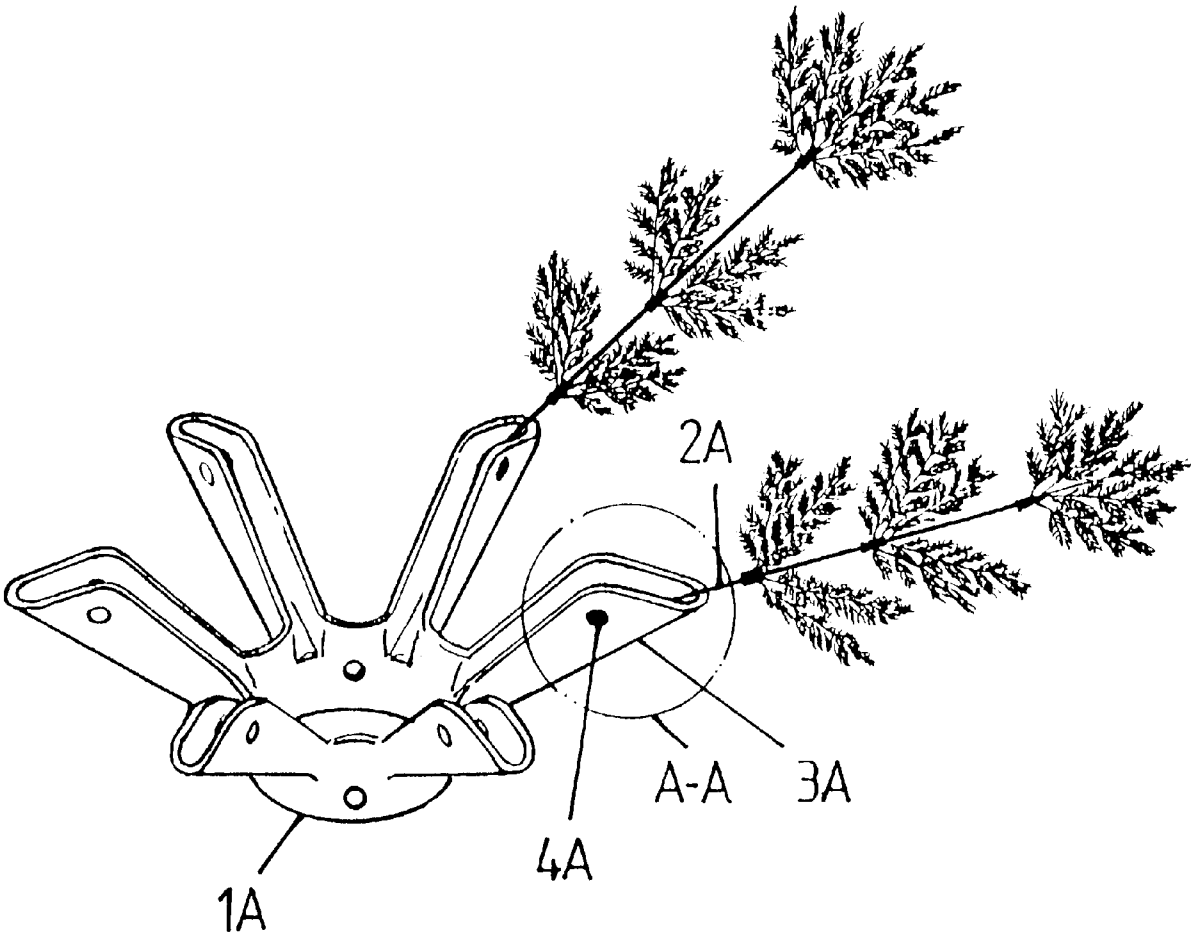
FIG 1 Prior Art
FIG. 1 is a perspective view of a conventional claw type branch joint.
Figure 2A:
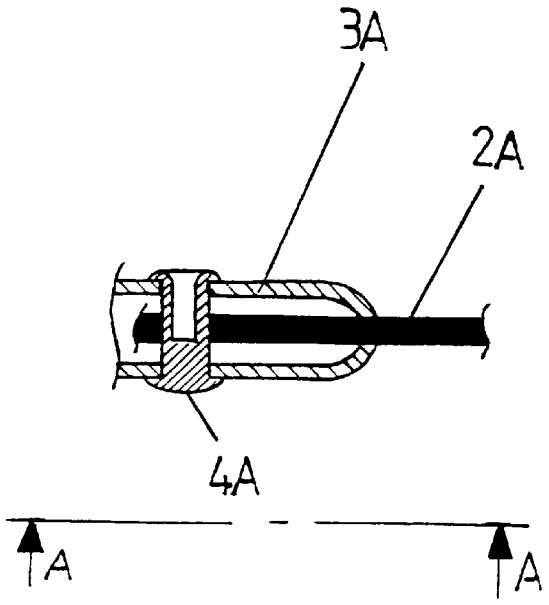
FIG 2A Prior Art
FIG. 2A is a top cross-sectional view of the conventional claw type branch joint in accordance with FIG. 1 showing the retention between a retention claw hereof and a branch.
Figure 2B:
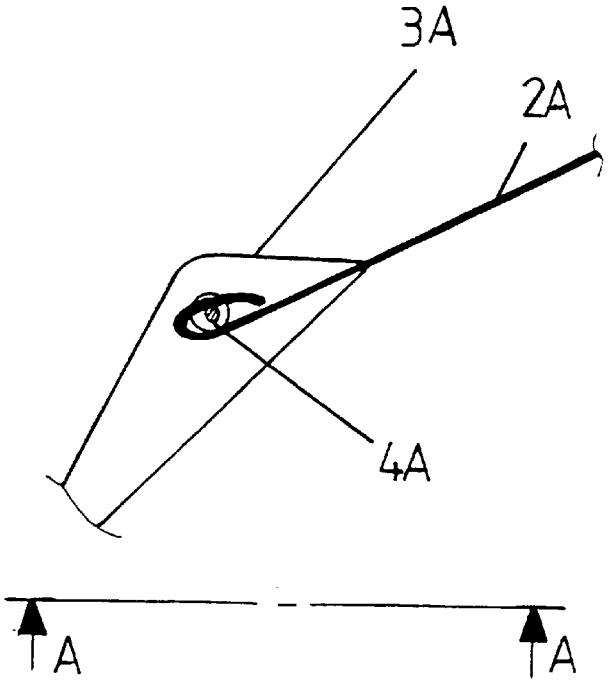
FIG 2B Prior Art
FIG. 2B is a lateral cross-sectional view of the conventional claw type branch joint in accordance with FIG. 1 showing the retention between a retention claw thereof and a branch.
Figure 3:
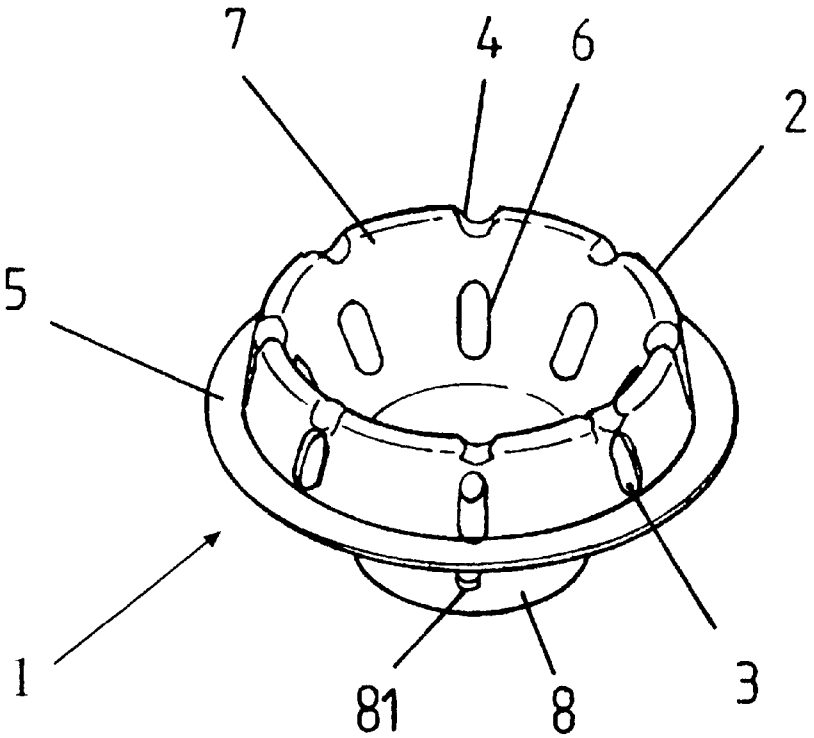
FIG. 3 is a perspective view of a branch joint in accordance with the present invention.

Referring to the perspective view shown in FIG. 3, the present invention provides a branch joint for use with an artificial christmas tree, forning an umbrella-shaped body 1. The body 1 is designed to form a conical circular pedestal 2 on a half top portion thereof. The circular pedestal 2 is further defined with a plurality of symmetric recesses 4 on a top edge thereof, a plurality of symmetric top ellipses 3 on the top circumference thereof and a plurality of symmetric bottom ellipses 6 on the bottom circumference thereof in opposition to said respective top ellipses 3 and recesses 4. A circular flange 5 extends around the circumference of the circular pedestal 2. A sleeve 8 is downward extended from a half bottom portion of the body 1 and arranged with two retentive bores 81 on opposed sides thereof. A hollow 7 vertically extends through both of the pedestal 2 and sleeve 8.

Figure 4:
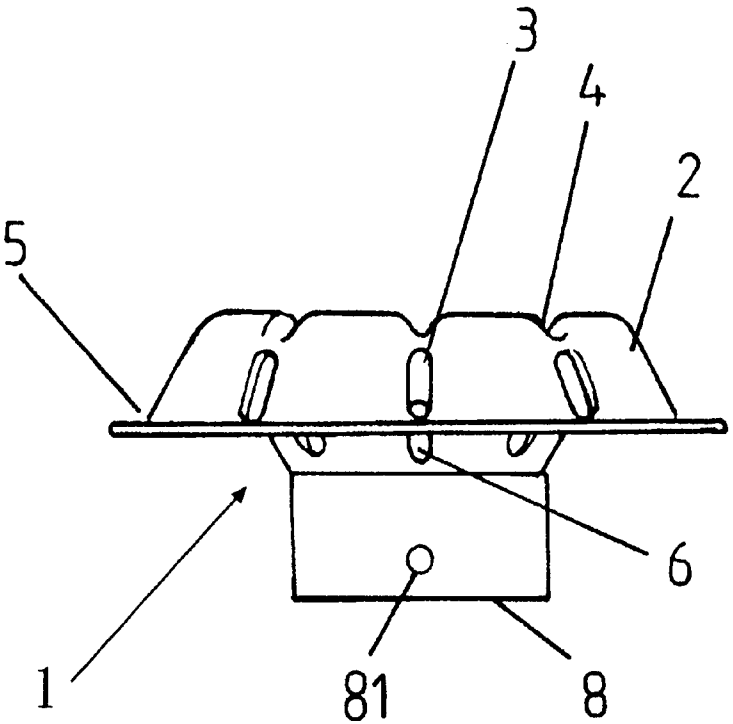
FIG. 4 is a front perspective view of the branch joint shown in FIG. 3.
Figure 5:
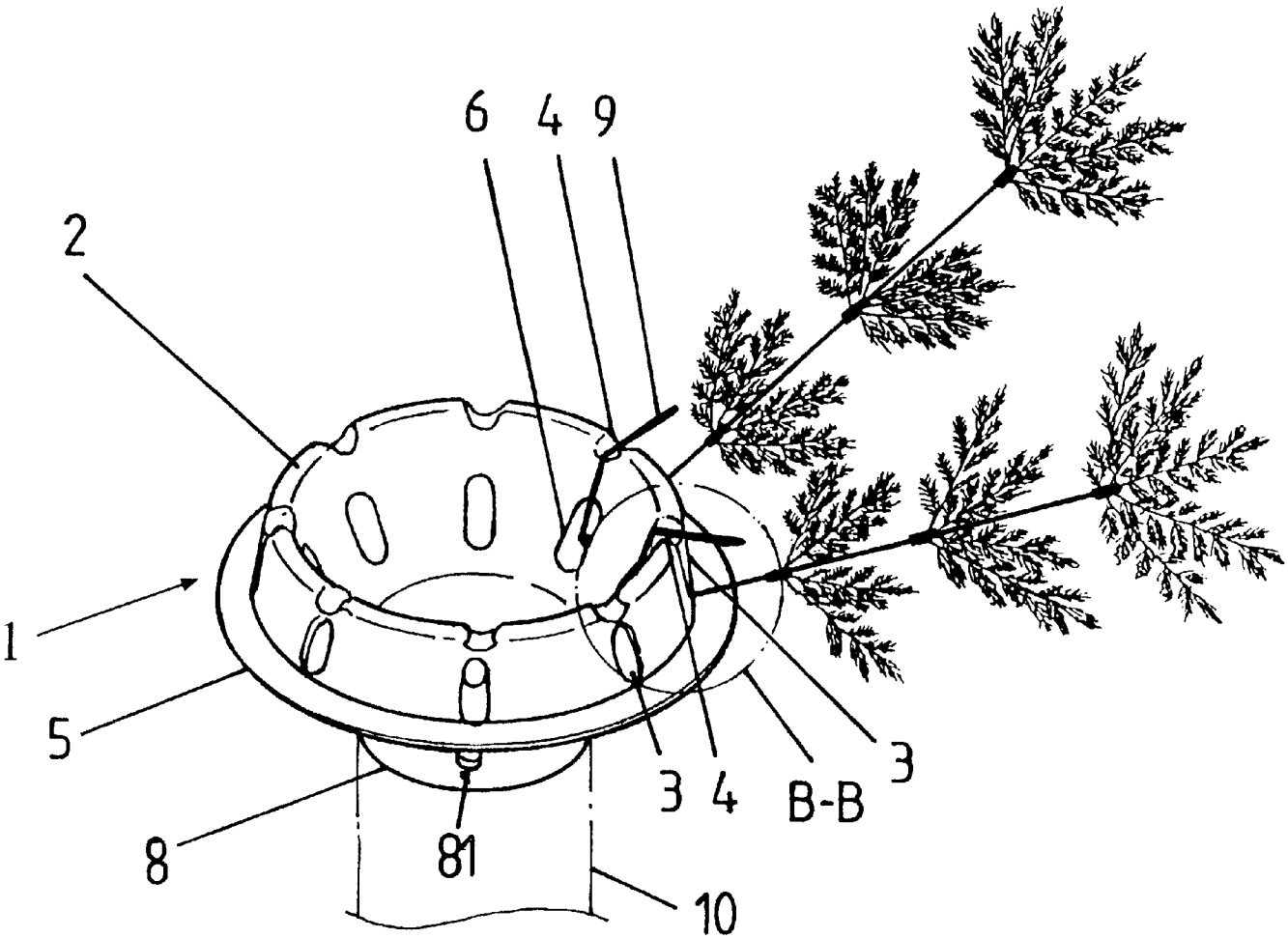
FIG. 5 is a perspective view of a preferred embodiment of the branch joint shown in FIG. 3.
Figure 6:
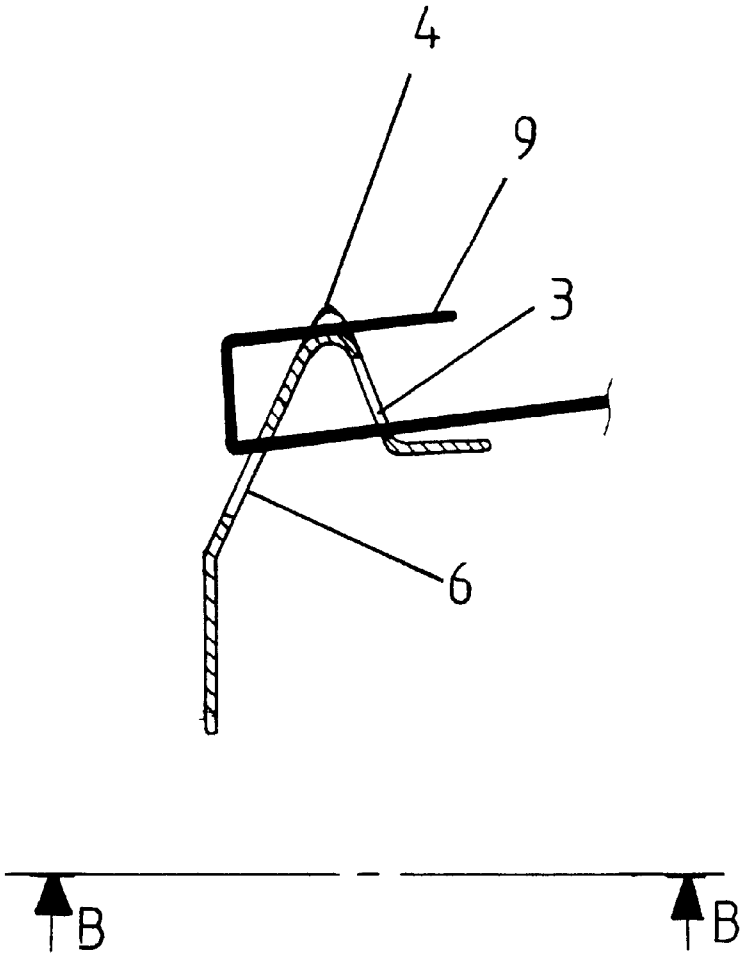
FIG. 6 is a cross-sectional view of the branch joint in accordance with FIG. 3 showing a recess and a pair of top and bottom ellipses for retaining a branch thereto.

Further referring to FIGS. 4–6, in assembly of attaching a additional branch to the body 1, the branch 9 with a appropriate length thereof is firstly inserted into the corresponding top ellipse 3 of the circular pedestal 2 of the umbrella-shaped body 1 and extended through the bottom ellipse 6 on the bottom circumference of the circular pedestal 2. Then, the inserted branch 9 is inward bent at a specific angle so as to retain a distal end of the branch 9 within the corresponding recess 4 on the top edge of the circular pedestal 2. Therefore, the retention between the body 1 and branches 9 is capable of constituting a more natural manner.

Finally, as shown in FIG. 6, the umbrella-shaped body 1 can be fixedly attached to a trunk 10 of the Christmas tree by way of screwing the retentive bores 81 and the trunk 10 together.

In conclusion, it is known that the branch joint in accordance with the present invention actually offers more merits in comparison with the conventional structure in the costs and time of the assembly and fabrication.

The present invention may be embodied in other specific forms without departing from its spirit or essential characteristics. The described embodiments are to considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A branch joint for use with an artificial tree to connect a plurality of branches to a trunk of the tree, comprising:

an umbrella-shaped body forming a conical circular pedestal on a top portion thereof; a plurality of symmetric top ellipses distributed on a circumference of said circular pedestal; a plurality of recesses defined at a top edge of said circular pedestal; a circular flange formed around the circumference of the circular pedestal and below said top ellipses; a plurality of symmetric bottom ellipses distributed on a bottom portion of said circular pedestal for corresponding to said top ellipses and recesses; a sleeve downward extending from a bottom portion of said body and arranged with two retentive bores on opposed sides thereof; and a hollow portion extending through both of the circular pedestal and the sleeve.

2. A combination, comprising:

a branch joint for use with an artificial tree to connect a plurality of branches to a trunk of the tree, the branch joint including:

an umbrella-shaped body forming a conical circular pedestal on a top portion thereof, a plurality of symmetric top ellipses distributed on a circumference of said circular pedestal, a plurality of recesses defined at a top edge of said circular pedestal, a circular flange formed around the circumference of the circular pedestal and below said top ellipses, a plurality of symmetric bottom ellipses distributed on a bottom portion of said circular pedestal for corresponding to said top ellipses and recesses, a sleeve downward extending from a bottom portion of said body and arranged with two retentive bores on opposed sides thereof, and a hollow portion extending through both of the circular pedestal and the sleeve; and at least one branch inserted into one of the top ellipses, through the corresponding bottom ellipse, and bent at an appropriate angle such that a distal end of the branch is received in the corresponding recess.

3. A branch joint for use with an artificial tree to connect a plurality of branches to a trunk of the tree, comprising: an umbrella-shaped body forming a pedestal on a top portion thereof; a plurality of top ellipses distributed on a circumference of said pedestal; a plurality of recesses defined at a top edge of said pedestal; a flange formed around the circumference of the pedestal and below said top ellipses; a plurality of bottom ellipses distributed on a bottom portion of said pedestal for corresponding to said top ellipses and recesses; a sleeve extending from a bottom portion of said body; and a hollow portion extending through both of the pedestal and the sleeve.

4. A combination, comprising:

a branch joint for use with an artificial tree to connect a plurality of branches to a trunk of the tree, the branch joint including:

an umbrella-shaped body forming a pedestal on a top portion thereof, a plurality of top ellipses distributed on a circumference of said pedestal, a plurality of recesses defined at a top edge of said pedestal, a flange formed around the circumference of the pedestal and below said top ellipses, a plurality of bottom ellipses distributed on a bottom portion of said pedestal for corresponding to said top ellipses and recesses, a sleeve extending from a bottom portion of said body, and a hollow portion extending through both of the pedestal and the sleeve; and at least one branch inserted into one of the top ellipses, through the corresponding bottom ellipse, and bent at an appropriate angle such that a distal end of the branch is received in the corresponding recess.

* * * * *